United States Patent [19]

Mako et al.

[11] 3,994,115

[45] Nov. 30, 1976

[54] METHOD OF PACKAGING PERISHABLE FOODS AND PRODUCT THEREOF

[75] Inventors: Isao Mako, Ichikawa; Hiroyuki Ishitobi, Tokyo; Masami Tomikawa, Chiba, all of Japan

[73] Assignee: Idemitsu, Kosan Kabushiki-Kaisha (Idemitsu Kosan Co., Ltd.), Tokyo, Japan

[22] Filed: Mar. 7, 1975

[21] Appl. No.: 556,089

Related U.S. Application Data

[63] Continuation of Ser. No. 419,369, Nov. 27, 1973, abandoned.

[30] Foreign Application Priority Data

Nov. 28, 1972 Japan ..... 47-119104

[52] U.S. Cl. ..... 53/29; 206/499; 206/523; 217/26.5; 217/27; 209/2.5 R; 209/2.5 FC; 264/51; 264/321; 264/DIG. 17; 264/DIG. 18; 426/119; 426/396; 426/392; B65D/85/34

[51] Int. Cl.[2] ..... B65D 85/30; B65D 85/32

[58] Field of Search ..... 264/DIG. 17, DIG. 18, 264/51, 321; 220/9 F; 229/2.5 R, 2.5 EC; 206/523, 499, 515, 516; 426/119, 392; 428/310, 180, 255; 217/26.5, 27, 6, 25.5

[56] References Cited

UNITED STATES PATENTS

| | | | |
|---|---|---|---|
| 3,146,929 | 9/1964 | Keim | 229/2.5 |
| 3,189,243 | 6/1965 | Lux | 220/9 F |
| 3,250,731 | 5/1966 | Buhl | 264/51 X |
| 3,332,895 | 7/1967 | Munn | 264/DIG. 17 |
| 3,342,365 | 9/1967 | Lux et al. | 220/9 F X |
| 3,441,523 | 4/1969 | Dwyer et al. | 264/DIG. 17 |
| 3,534,128 | 10/1970 | Makowski | 229/2.5 X |
| 3,627,706 | 12/1971 | Chant | 264/DIG. 17 |
| 3,725,520 | 4/1973 | Suzuki et al. | 264/DIG. 17 |
| 3,812,225 | 5/1974 | Hosoda et al. | 264/DIG. 17 |
| 3,818,086 | 6/1974 | Stastny | 264/DIG. 17 |
| 3,846,523 | 11/1974 | Geerdes | 264/DIG. 17 |

OTHER PUBLICATIONS

Hndbk. of Foamed Plastics, 1965, pp. 192–194.

*Primary Examiner*—Steven L. Weinstein
*Attorney, Agent, or Firm*—William J. Daniel

[57] ABSTRACT

Plural recesses are formed on the surface of a sheet of a chemically crosslinked foam of a polyolefinic resin containing an inorganic calcium compound, the articles of food to be packaged are placed in the recesses and then the sheet is covered with a physically foamed sheet of a polyolefinic resin containing an inorganic calcium compound. Alternatively, the physically foamed sheet can be shaped to define a recessed support for the food articles and a sheet of foamed polyolefinic resin used as the covering. The polyolefinic resin has 30–60% by weight of an inorganic calcium compound incorporated therein.

4 Claims, 4 Drawing Figures

METHOD OF PACKAGING PERISHABLE FOODS AND PRODUCT THEREOF

This is a continuation, of Ser. No. 419,369, filed Nov. 27, 1973, now abandoned.

BACKGROUND OF THE INVENTION

This invention relates to a method of packaging perishable foods. More particularly, this invention relates to a method of packaging perishable foods suitable to keep them fresh without suffering injury on their surface during storage or transportation.

In the case of perishable foods such as fruits, vegetables, root-crops and eggs, commercial values are largely influenced by freshness and extent of injury. As the places where these foods are produced are generally far distant from urban areas, long-distance transportation is required for supplying the foods to consumers in urban areas. Therefore, it is a key technical problem in such long-distance transportation of perishable foods to avoid deterioration of freshness and keep the degree of superficial injury as low as possible thereby maintaining the commercial value of such foods.

In the prior art, methods utilizing paper or pulp-mold packages as well as methods utilizing sheets of foamed resins are employed for packaging such perishable foods. In the former methods, however, there are some drawbacks, i.e., poor water resistance makes the foods non-hygienic, low cushioning action results in damaging of the contents after falling or shock, and poor dimensional stability against change in temperatures causes injury of the contents. On the other hand, the latter methods have also some drawbacks, i.e., inferior air-permeability and moisture-permeability fail to maintain freshness of perishable foods, injury is caused on the surface of the packaged products, and the packaging material tends to be damaged. Accordingly, all of these methods are unsatisfactory because of these drawbacks.

BRIEF SUMMARY OF THE INVENTION

It is an object of this invention to provide a method of packaging perishable foods suitable for keeping them fresh and injury-free during a long-term storage or a long-distance transportation.

It is another object of this invention to provide a method of packaging soft-skinned fruits or perishable fruits and vegetables to keep them fresh and injury-free.

The other objects, features and advantages of this invention will become apparent more fully from the following descriptions and annexed drawings, in which.

DETAILED DESCRIPTION OF THE INVENTION

Figure 1:
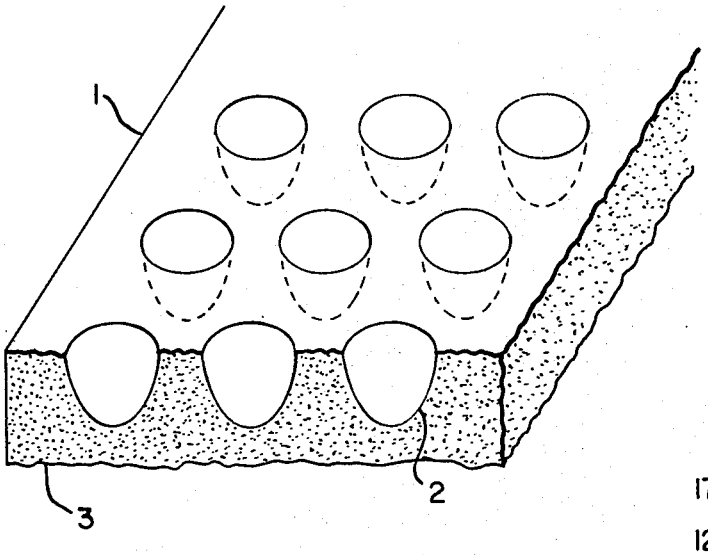
FIG. 1 is a perspective view, partially in section, of one example of the packaging materials used in the practice of this invention.

In the method of this invention, it is necessary to use as one packaging material a combination of a chemically crosslinked foam of a polyolefinic resin incorporating a relatively large amount of an inorganic calcium compound and a physically foamed material of the polyolefinic resin. Good packaging results can be achieved by using such combination.

The polyolefinic resins utilizable for packaging purposes include polyethylene, polypropylene, polybutadiene, polyisoprene, ethylene/vinyl acetate copolymer, ethylene/propylene copolymer, styrene/butadiene copolymer and a mixture of polyethylene and polybutadiene. Any of the homopolymers, copolymers and mixtures may be used so far as they are composed predominantly of polyolefin. To obtain good packaging results in the method of this invention, it is necessary to use these resins incorporated with a comparatively large amount of an inorganic calcium compound. Suitable as the inorganic calcium compound are inorganic compounds containing calcium as a constituent, such as calcium carbonate, calcium sulfate, calcium hydroxide and calcium silicate. Besides these, talc, diatomaceous earth, alumina, silica and the like can also be used equivalently. These compounds are used singly or in a mixture of more than one usually in the form of powders having a particle size of less than $20\mu$, preferably less than $10\mu$. In this invention, these inorganic compounds are used in the mixture in a comparatively large amount of at least 30% by weight. These inorganic calcium compounds exhibit excellent compatability with the resins and act as nuclei for foaming, thus serving to produce a uniform, fine foam.

In the method of this invention, the polyolefinic resin incorporated with such inorganic calcium compound is subjected to a chemically crosslinking foaming treatment and a physical foaming treatment to prepare separate kinds of foam sheets, one of which, i.e., the sheet of chemically crosslinked foam, is used as packaging material supporting the material to be packaged in its recesses, and the other of which, i.e., the sheet of physically foamed body, is used as protecting material to be overlaid on the contents to support the same.

The chemically crosslinking foaming treatment is carried out by adding a foaming agent and a crosslinking agent to a mixture of the inorganic calcium compound and the polyolefinic resin, well kneading the mixture at a temperature of 90°–150° C, charging the kneaded mixture into a confined metal die in a compression molding machine, heating the mixture at a temperature of 180°–200° C under pressure and then releasing the metal die at one time. In this foam shaping treatment, the foaming agent may be a conventional one such as azo-dicarbonamide, diphenylsulfon-3,3'-disulfohydrazide, benzenesulfonyl diphenylhydrazide or the like, while the crosslinking agent may be an organic peroxide such as di-tertiary-butyl peroxide, 1,3-bis(tertiary-butyl peroxyisobutyl)benzene, dicumyl peroxide or the like. The content of the crosslinking agent can range from 0.1–0.3% of the total weight of resin and calcium compound.

In this invention, the foamed material usually in the form of a thick slab is first manufactured according to the chemically crosslinking foaming treatment. This foamed material is excellent in cutting and shaving characteristics, cushioning action and dimensional stability by the action of a specifically selected inorganic calcium compound. The foamed material in slab form is then cut into sheets having a desired thickness, which are then subjected to a pattern-stamping or vacuum molding treatment to form recesses having a shape corresponding with the goods to be packaged. FIG. 1 is a perspective view of a section of an example of packaging material manufactured in this manner. In the drawing, 1 is a sheet of a chemically crosslinked foam, 2 is a recess formed in one of the surfaces of the sheet so as to support therein the product to be packaged, and 3 is a foam cell formed by the action of the inorganic calcium compound as nucleus.

On the other hand, the physical foaming treatment is carried out by charging a mixture of the inorganic calcium compound and the polyolefinic resin into a foam molding extruder, introducing under pressure a liquidized hydrocarbon such as liquidized butane or buylene as physical foaming agent into the extruder, and then extruding the mixture into the open air to yield a physically foamed material which is composed chiefly of continuous foam cells and has an extremely high foaming magnification. Further, this foamed material has a cotton-like surface and possesses good cushioning action, moisture-permeability and air-permeability.

Figure 2:
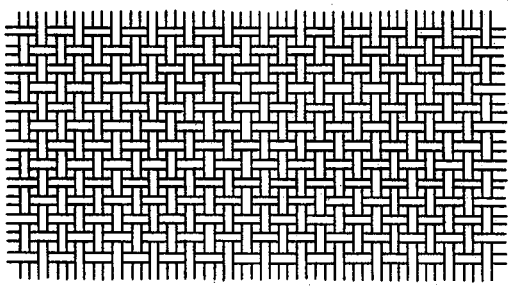
FIG. 2 is a plan view showing one example of the sheets to be overlaid on the contents to be packaged.

In this invention, the physically foamed material is shaped into sheets and then placed over the goods contained in the recesses formed in the packaging material whereby the articles are protected by the physically foamed sheet. In addition to the normally processed ordinary sheet, a perforated sheet obtained by punching the ordinary sheet or a network sheet manufactured by weaving a tape obtained by extrusion molding may also be used as covering sheet in this invention. FIG. 2 shows an example of a woven sheet.

Perishable foods to which this invention is applicable include fruits, such as apples, oranges and pears; rootcrops, such as yams; vegetables, such as celery, cabbage and lettuce, and other foods, such as eggs, fish and shellfish. According to this invention, these perishable foods are packaged by placing them in recesses formed in a packaging material comprised of the chemically crosslinked foam and covering them with the physically foamed sheet. In packaging a large quantity of perishable foods, the packaged sheets thus obtained are stacked. In this case, the lowermost layer is preferably underlaid with the physically foamed sheet to achieve more enhanced buffer effect.

Figure 3:
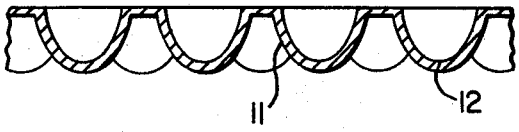
FIG. 3 is a sectional view showing another example of packaging materials useful in the practice of this invention.

According to another embodiment of this invention, the packaging material for supporting the product to be packed may be comprised of the physically foamed material instead of the chemically crosslinked foam. In this embodiment, a foamed material prepared according to the physical foaming treatment is first shaped into sheets which are then subjected to a pattern-stamping or vacuum molding treatment to form recesses having a figure corresponding to the product to be packaged. FIG. 3 shows an example of this sheet. Another physically foamed material is shaped into sheets and laid over the articles situated in the recesses in the packaging material whereby the product is protected by the overlaid sheet. In this case, the shape of sheets may be the same as described above.

This embodiment is suitable for packaging the aforementioned perishable foods, especially soft-skinned fruits or rapidly perishable fruits and vegetables. According to this embodiment, these perishable foods are packaged, as in the case of the first-mentioned embodiment, by placing them in recesses formed in a packaging material comprised of the physically foamed sheet and overlaying the packaging material with a similar physically foamed sheet. In packaging a large quantity of perishable foods, the packaged sheets thus obtained are stacked as described above.

Figure 4:
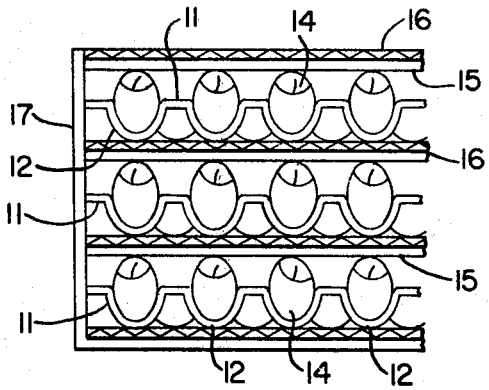
FIG. 4 is a schematic diagram showing a packaged assembly using the packaging material of FIG. 3.

FIG. 4 is a diagram showing the arrangement of perishable foods packaged in this manner, wherein 11 is a sheet of the physically foamed material comprised of a polyolefinic resin incorporating a comparatively large amount of the inorganic compound and acts as the packaging support, 12 is a recess formed in the sheet 11, 14 is a perishable article of food placed in the recess, 15 is a sheet of a similar physically foamed material comprised of a polyolefinic resin incorporating a comparatively large amount of an inorganic compound and acts as a protecting material, and 17 is a case for accommodating the packaged sheets. This figure shows an example of three packaged sheets in a stack. In practicing this invention, a carton board 16 is preferably inserted between the packaging support 11 and the protecting material 15 and provided at the top and bottom of the stacked packages to achieve more enhanced cushioning effect.

According to this invention, extremely remarkable advantages over the prior art packaging techniques can be achieved. As the packaging materials used in this invention are excellent in dimensional stability and bending characteristics, tightness between the packaging material and the packaged product is kept moderate, thus preventing the packaged product from damage such as superficial injury even in the case of long-distance transportation. The packaging material has on its surface a soft skin layer which is rich in luster and attractive in appearance. Moreover, the packaging material has good water-resistance and air-permeability and prevents perishable foods from spoiling, enabling a long-term preservation of the foods. In this invention, the use of the physically foamed sheets of cotton-like appearance, which is high in foaming magnification and has excellent cushioning action, air-permeability and moisture-permeability, serves to enhance the packaging effect remarkably as compared with the prior art packaging methods. When the packaged products are stacked, the physically foamed sheets function as excellent cushions and absorb shock and vibration during transportation to protect the packaged products from shock and vibration.

This invention will be explained in more detail by way of the following examples.

EXAMPLE 1

A. Manufacture of the Protecting Sheets

A given quantity of polyolefinic resin pellets were charged into an intermixer K-1 (manufactured by Hitachi-Taura, capacity = 5 liters) having a pair of rotating rolls and softened by external heating. To the heated polyolefinic resin was then added a given quantity of an inorganic calcium compound and the mixture was continuously kneaded. The temperature of the kneaded mixture was gradually elevated with lapse of time. The resulting kneaded mixture was discharged from the intermixer, cooled and crushed into granules.

The granules were supplied to an extruder of 50 mm diameter and heated at three stages, while introducing a liquified gas, i.e., liquified butane, into the second stage heating zone under pressure, i.e., 25–30 kg/sq. cm., and extruded in the form of a foamed rope having a diameter of 2 mm.

The foamed rope thus obtained is bound by fusion to form a network sheet as shown in FIG. 2.

The detailed molding conditions and the density of the resulting foam in this case are shown in Table 1, wherein all amounts are parts by weight, all time is in minutes, all temperatures are in ° C, and all densities in g/cc.

Table 1

| Sheet No. | Resin Type | Resin Amt | Cal. Cpd. Type | Cal. Cpd. Amt | Kneading Conditions Temp. | Kneading Conditions Time | Foaming Conditions 1st Heat Zone | Foaming Conditions 2nd Heat Zone | Foaming Conditions 3rd Heat Zone | Foam Density |
|---|---|---|---|---|---|---|---|---|---|---|
| A | P-E[1] | 40 | $CaSO_3$ | 60 | 95–130 | 5 | 130–150 | 150–190 | 100–120 | 0.050 |
| B | P-E | 40 | $CaSO_4$ | 60 | 95–130 | 6 | " | " | " | 0.043 |
| C | P-E | 40 | $CaCo_3$ | 60 | 95–130 | 8 | " | " | " | 0.031 |
| D | P-P[2] | 70 | $CaSO_3$ | 30 | 110–150 | 8 | " | " | " | 0.034 |

[1]Polyethylene: density 0.923, melt index 5.0
[2]Polypropylene: a mixture of 50 parts by weight of poly-propylene and 20 parts by weight of polyethylene B. Manufacture of Sheets of Chemically Crosslinked Foam A mixture of a polyolefin, an inorganic calcium compound, azodicarboxylamide as a foaming agent, and 1,3-bis(tertiary-butylperoxyisopropyl)benzene as a crosslinking agent was homogeneously kneaded at a temperature of 90–100° C for about three minutes.

The kneaded mixture was charged into a confined metal die in a compression molding machine heated under a pressure of 30 kg/cm² at 180°–200° C for 13 minutes and then released at one time from the metal die to obtain a shaped article in the form of a plate. Table 2 shows the type of polyolefinic resin composition used and the density of the resulting foam. The shaped article in the form of a plate was subjected to pattern-stamping treatment to obtain a packaging material as shown in FIG. 1.

TABLE 2

| | Resin Type | Resin Amt | Cal. Cpd. Type | Cal. Cpd. Amt | Foaming Agent Type | Foaming Agent Amt | Crosslinking Agent Type | Crosslinking Agent Amt | Foam Density |
|---|---|---|---|---|---|---|---|---|---|
| a | P-E | 40 | $CaSO_3$ | 60 | ADA[1] | 50 | TBPIB[2] | 0.3 | 0.130 |
| b | " | 40 | $CaSO_4$ | 60 | " | 2.5 | " | 0.20 | 0.184 |
| c | " | 40 | $CaCo_3$ | 60 | " | 2.0 | " | 0.20 | 0.219 |

[1]Azodicarboxyamide
[2]1,3-bis(t-butylperoxyisopropyl)benzene

C. Transportation Test

In two packaging supports each having 18 recesses obtained according to procedure (B), 36 pears were placed and one of these was packed in a carton box the bottom of which had been covered with the network sheet obtained in procedure (A). The filled packaging support was overlaid with another network sheet obtained as in (A) and the second packaging support filled with pears was stacked on the first. The top packaging support was also covered with the network sheet obtained as in (A) to make a package. The carton box packed with pears was then shipped as railway luggage from the Tottori prefecture to the Osaka Central Market, remaining in transit for about five days. The test was repeated with the various examples of materials produced in (B) which are designated *a*, *b*, or *c* as in Table 2.

Table 3 shows the results of the transportation test in comparison with the results of Comparative Examples conducted at the same time. In Comparative Example 1, a package was prepared according to a conventional method by coating pears with polyethylene net, placing 18 pears thus coated in a carton box the bottom of which had been covered with a foamed polyethylene sheet, overlaying the pears with a foamed polyethylene sheet, placing additional 18 pears coated similarly with polyethylene net on the sheet, and overlaying the additional pears with a foamed polyethylene sheet. In Comparative Example 2, two foamed polystyrene (P-S) packaging sheets each having 18 recesses were prepared and each was packed with 18 pears. A package was prepared by placing one of the sheets packed with pears in a carton box the bottom of which had been covered with a cushioning material manufactured by bonding polyethylene sheets onto both sides of a board paper, overlaying the packed sheet with another sheet of the cushioning material, stacking

TABLE 3

| Packaging Example | Type of Packaging Material | Injury of Packaging Material | Discoloration of Fruit | Ratio of Injured Pears* |
|---|---|---|---|---|
| 1 | A, B(a) | None | None | 2/36 |
| 2 | A, B(a) | None | None | 2/36 |
| 3 | A, B(b) | None | None | 3/36 |
| 4 | A, B(c) | None | None | 2/36 |
| 5 | A, B(c) | None | None | 3/36 |
| 6 | A, B(c) | None | None | 4/36 |
| 7 | A, B(a) | None | None | 3/36 |
| Comparative Ex. 1 | P-E net + P-E Foam Sheet | None | Discolored | 11/36 |
| Comparative Ex. 2 | P-E Bonded Board + P-S Foam Sheet | Cracked | Discolored | 23/36 |

*Those having a ring luster on the surface were determined as "injured."

thereon the other packaging sheet packed with pears, and then overlaying that sheet with a final cushioning sheet.

EXAMPLE 2

A. Manufacture of the Protecting Sheet

A given amount of polyolefinic resin pellets were charged into an Intermixer K-1 (manufactured by Hitachi-Taura Co., Ltd., capacity: 5 liters) having a pair of rotating rolls and softened by external heating. To the heated polyolefin was added a given amount of an inorganic compound and the mixture was continuously kneaded, whereby the temperature of the kneaded mixture was gradually elevated with the lapse of time. The resulting kneaded mixture was discharged from the intermixer, cooled and crushed into granules.

The granules were supplied to an extruder of 100 mm diameter and heated at three stages while introducing a liquified gas into the second stage heating zone as before, and extruded in the form of a foamed sheet having a thickness of 2 mm.

Table 4 shows the physical properties of the foamed sheet thus obtained.

TABLE 4

| Resin Composition | | Foam | | | |
|---|---|---|---|---|---|
| Polyolefinic | Inorganic | | | | |
| Type | Amt | Compound Type | Amt | Density | State of Foam Cells |
| High Pr. P-E[1] | 40 | $CaSO_3$ | 60 | 0.059 | Partially Continuous |
| | | | | 0.035 | " |
| | | | | 0.016 | Continuous |
| | | | | 0.050 | " |
| Med. Low P-E[2] | 40 | $CaSO_4$ | 60 | 0.053 | Partially Continuous |
| | | | | 0.030 | Continuous |
| | | | | 0.010 | " |
| | | | | 0.047 | " |
| P-P[3] | 40 | $CaSO_3$ | 60 | 0.063 | Partially Continuous |
| | | | | 0.036 | Continuous |
| | | | | 0.011 | " |
| | | | | 0.051 | " |
| Mixture (1:1) High Pr. P-E & P-P | 40 | $CaCO_3$ | 60 | 0.059 | Partially Continuous |
| | | | | 0.033 | Continuous |
| | | | | 0.015 | " |
| | | | | 0.048 | " |
| Mixture (1:1) Med. Low Pr. P-E & P-P | 40 | $CaSO_3$ | 60 | 0.059 | Partially Continuous |
| | | | | 0.035 | Continuous |
| | | | | 0.011 | " |
| | | | | 0.043 | " |

[1]Density = 0.923 g/cm³, Melt index 5.0
[2]Density = 0.960 g/cm³, Melt index 14.0
[3]Density = 0.910 g/cm³, Melt index 13.0

B. Manufacture of the Packaging Support

A given amount of pellets composed of low density polyethylene and medium density polyethylene was charged into an Intermixed K-1 (manufactured by Hitachi-Taura Co., Ltd., capacity: 5 liters) having a pair of rotating rolls and softened by external heating. To the heated polyethylene was then added a given amount of an inorganic compound and the mixture was continuously kneaded whereby the temperature of the kneaded mixture was gradually elevated with the lapse of time. The resulting kneaded mixture was discharged from the intermixer, cooled and crushed into granules.

The granules were then supplied to an extruder of 100 mm diameter and heated at three stages while introducing a liquified gas into the second stage heating zone as before and extruded in the form of a foamed sheet having a thickness of 2 mm. This sheet was subjected to a vacuum molding treatment to obtain a packaging material as shown in FIG. 3.

Table 5 shows the densities of the formed materials obtained in this manner.

TABLE 5

| Resin Composition | | | | | | | | |
|---|---|---|---|---|---|---|---|---|
| Low Density P-E | | | Medium Density P-E | | | Inorganic Compound | | Foam |
| Dens. | MI | Amt | Dens. | MI | Amt | Type | Amt | Dens. |
| 0.916 | 23 | 20 | 0.920 | 0.6 | 70 | $CaSO_3$ | 10 | 0.34 |
| 0.916 | 23 | 45 | 0.920 | 0.6 | 45 | $CaSO_3$ | 10 | 0.25 |
| 0.916 | 23 | 70 | 0.920 | 0.6 | 20 | $CaSO_3$ | 10 | 0.10 |
| 0.916 | 23 | 15 | 0.920 | 0.6 | 55 | $CaSO_3$ | 30 | 0.45 |
| 0.916 | 23 | 35 | 0.930 | 0.6 | 35 | $CaSO_3$ | 30 | 0.30 |
| 0.916 | 23 | 55 | 0.920 | 0.6 | 15 | $CaSO_3$ | 30 | 0.15 |
| 0.916 | 23 | 10 | 0.920 | 0.6 | 40 | $CaSO_3$ | 50 | 0.51 |
| 0.916 | 23 | 25 | 0.920 | 0.6 | 25 | $CaSO_3$ | 50 | 0.40 |
| 0.916 | 23 | 40 | 0.920 | 0.6 | 10 | $CaSO_3$ | 50 | 0.25 |
| 0.916 | 23 | 15 | 0.920 | 0.6 | 55 | $CaSO_4$ | 30 | 0.41 |
| 0.916 | 23 | 15 | 0.920 | 0.6 | 55 | Diat. Earth | 30 | 0.45 |
| 0.916 | 23 | 15 | 0.920 | 0.6 | 55 | $Al_2O_3 3H_2O$ | 30 | 0.49 |
| 0.916 | 23 | 15 | 0.920 | 0.6 | 55 | $SiO_2$ | 30 | 0.47 |
| 0.917 | 8 | 15 | 0.920 | 0.6 | 55 | $CaCO_3$ | 30 | 0.46 |
| 0.917 | 8 | 35 | 0.920 | 0.6 | 35 | $CaCO_3$ | 30 | 0.29 |
| 0.917 | 8 | 55 | 0.920 | 0.6 | 15 | $CaCO_3$ | 30 | 0.17 |

C. Transportation Test

Three packaging supports obtained according to procedure (B) of this Example 2, each having 16 recesses, were prepared and packed with 48 pears in all. A carton was prepared by placing one of the pear-packed supports in a carton box, the bottom of which had been covered with a sheet of board paper, overlaying the filled support with the protective sheet obtained as in (A), covering the sheet with a sheet of board paper, then stacking thereon another pear-packed support and repeating this operation once more to obtain a three-layer stack. Ten cartons packed with pears in this manner were shipped from the Tottori Prefecture to the Tokyo Kanda Market as hand-luggage, with a transit time of about three days to determine an average ratio of pears injured during the transportation.

Table 6 shows the results of this transportation test in comparison with the results of Comparative Examples conducted at the same time. In Comparative Example 3, a carton was prepared in a similar manner to pack a carton box with 48 pears except that a similar polystyrene pack was used as the packaging material. In Comparative Example 4, a package was prepared in a similar manner except that pulp-mold packs having recesses were used as the packaging material and packed with 48 pears.

As many modifications to this invention may be made without departing from the spirit and scope thereof, it is to be understood that this invention is not limited to the specific embodiments illustrated herein except as defined in the claims.

TABLE 6

| Packaging Method | Injury of Packaging Material | Discoloration of Fruit | Ratio of Injured Pears* |
|---|---|---|---|
| This Invention | None | None | 2/48 |
| Comp. Ex. 3 | Partially Broken | None | 5/48 |
| Comp. Ex. 4 | None | Discolored | 48/48 |

*Evaluated both as to injury by mutual contact of fruit (contusion) and injury by contact of fruit with pack (abrasion).

What is claimed is:

1. A method of packaging perishable articles of foods comprising forming a foamed sheet having recesses, such sheet being of a chemically cross-linked and chemically foamed mixture of a polyethylene or polypropylene resin and about 30–60% by weight of at least one calcium compound selected from the group consisting of calcium sulfate, calcium sulfite, and calcium carbonate in the form of particles having a size less than about 20 microns, said recesses being shaped to correspond to articles to be package, placing the articles in the respective recesses of said foamed sheet, and overlaying them with a flexible, uncross-linked physically foamed network sheet of a polyethylene or polypropylene resin containing about 30–60% by weight of at least one of said calcium compounds.

2. A method according to claim 1 wherein the chemically crosslinked foam is produced by using azodicarbonamide as a foaming agent and 1,3-bis(t-butyl peroxyisopropyl)benzene as a crosslinking agent.

3. A method according to claim 1 wherein said physically foamed sheet is produced by admixing a liquefied gas into a heated mixture of said resin and said inorganic compound under pressure, and thereafter releasing said mixture from said pressure.

4. A protective packaging for perishable articles of food comprising a preformed bottom support having recesses in one surface thereof for receiving said articles in the respective recesses and a flexible cushioning top network sheet overlaying said articles, said bottom support being formed of a sheet of a chemically crosslinked and chemically foamed mixture of a polyethylene or polypropylene resin and about 30–60% by weight of particles of a size less than about 20 microns of an inorganic calcium compound selected of the group consisting of calcium sulfate, calcium sulfite, and calcium carbonate, said top sheet being formed of a uncross-linked physically foamed mixture of said resin and said particles within said weight range.

* * * * *